US005356212A

United States Patent [19]

Okopny

[11] Patent Number: 5,356,212

[45] Date of Patent: Oct. 18, 1994

[54] PLASTIC VENDOR WITH METAL INSERT

[76] Inventor: Morris Okopny, 6616 Snow Goose Lane, Mississauga, Ontario, Canada, L5N 5H5

[21] Appl. No.: 988,408

[22] Filed: Dec. 7, 1992

[51] Int. Cl.[5] ..... A47B 47/00

[52] U.S. Cl. ..... 312/263; 312/319.2; 221/282

[58] Field of Search ..... 312/61, 50, 71, 319.2, 312/215, 263; 221/279, 282, 155

[56] References Cited

U.S. PATENT DOCUMENTS

| | | | |
|---|---|---|---|
| 1,185,793 | 6/1916 | Hanson | 312/71 X |
| 2,696,324 | 12/1954 | Jones | 221/282 X |
| 4,449,643 | 5/1984 | Voegeli | 312/50 |
| 4,544,081 | 10/1985 | Voegeli | 221/155 |
| 4,718,532 | 1/1988 | Chalabian | 221/155 X |
| 4,919,250 | 4/1990 | Olson | 221/282 X |

*Primary Examiner*—Kenneth J. Dorner
*Assistant Examiner*—David E. Allred
*Attorney, Agent, or Firm*—Ridout & Maybee

[57] ABSTRACT

A vending device for vending newspapers and the like, comprising a plastic housing, a metal insert and a plastic base. The metal insert is retained in a channel in the housing and supported by the base, and includes an access door for accessing an inventory storage compartment, and a secure compartment containing a coin or credit card operated latch mechanism.

14 Claims, 5 Drawing Sheets

PLASTIC VENDOR WITH METAL INSERT

FIELD OF THE INVENTION

This invention relates to a vending device. In particular, this invention relates to a plastic newspaper vendor having a metal insert for dispensing newspapers, magazines and the like.

BACKGROUND OF THE INVENTION

Conventionally newspaper vendors have been constructed entirely from metal. Originally such vendors comprised simply a covered box open at the front having a cash box for the insertion of coins. However, significant losses were incurred by operators of such newspaper vendors, due to persons removing newspapers from the vendor without depositing the required coinage. Accordingly, enclosed newspaper vendors were developed, in which the interior of the vendor is accessible only through a door locked by a latch which is operated by a coin mechanism. A user must deposit the required coinage in order to release the latch and obtain access to newspapers inside the vendor.

Such vendors have been and continue to be made entirely or substantially of metal. This is primarily because a vending machine must be capable of withstanding the elements and be reasonably secure from theft and vandalism which requires extremely close tolerances in the door and latch mechanisms. These tolerances are virtually impossible to attain with plastic which tends to expand and shrink, and warp over time when exposed to the elements. Moreover, substantial strength in the exterior panels is required, so that deposited coins will not be stolen and the coin operated latch mechanism cannot be easily circumvented. Plastic does not provide the strength to resist theft or vandalism, but metal is expensive and does not withstand the elements well, rusting and decomposing over time and thus causing mechanical and security problems, as well as aesthetic deterioration.

The present invention overcomes these disadvantages by providing a plastic newspaper vendor with a metal insert for dispensing newspapers, magazines or the like. The metal insert comprises a secure storage compartment for storing coins, and includes provisions for a door, latch, coin mechanism and cash box. Thus, the mechanisms and structures which require close tolerances are formed of metal, and deposited coins are stored in a secure metal compartment which resists theft and tampering. However, the insert itself is contained within a plastic cabinet that protects the metal insert from the elements while being less expensive and more durable than metal vendor cabinets.

One of the primary difficulties encountered in producing such a newspaper vendor is the manner of attaching the metal insert to the plastic cabinet. There is no known satisfactory method for attaching metal to plastic which is sufficiently durable and secure that the insert cannot be simply detached from the plastic housing and carted away by a thief. The present invention provides a means for slip-fitting the insert into the plastic cabinet, and blocking the insert into an upper portion of the cabinet, thus preventing removal of the insert except by authorized service personnel. The present invention also permits a single plastic cabinet to be utilized with metal inserts of various designs, for vending tabloid style newspapers, broad sheet style newspapers, magazines, etc. as may be desirable at any particular time.

The present invention further provides a locking mechanism for the secure compartment which is wholly contained within the vendor. Conventionally a housing is affixed to the top of a storage container, and contains the latch mechanism and cash box. The housing is closed at the back by a hood which is locked to the housing using a bolt and padlock, both exposed to the elements. The present invention locates the access to the secure compartment at the front thereof, closed by a hinged panel which is locked by a spring-loaded latch located inside the compartment and locked by a padlock located in the inventory storage area where it is protected from the elements.

SUMMARY OF THE INVENTION

The present invention provides a vendor comprising a plastic cabinet having top, side and rear panels, the cabinet being provided with a channel along an interior front edge, a metal insert having a door locked with a coin, bill or magnetic card operated latch mechanism, and a secure compartment located above a storage compartment within the cabinet for storing inventory, the latch mechanism being contained within the secure compartment.

The present invention further provides a vendor comprising a plastic cabinet including means for retaining an insert, a plastic base including means for supporting the insert, the cabinet being seated upon the base, the metal insert comprising a door and a secure compartment including means for releasably latching the door, the door permitting access to an inventory storage compartment within the cabinet.

The present invention further provides a vendor comprising a plastic cabinet having a top, side and rear panels and a metal insert having a door biased to a closed position and locked with a coin or credit card operated latch mechanism, the metal insert including a secure compartment containing the latch mechanism.

BRIEF DESCRIPTION OF THE DRAWINGS

In drawings which illustrate by way of example only a preferred embodiment of the invention.

DETAILED DESCRIPTION OF THE INVENTION

Figure 1:
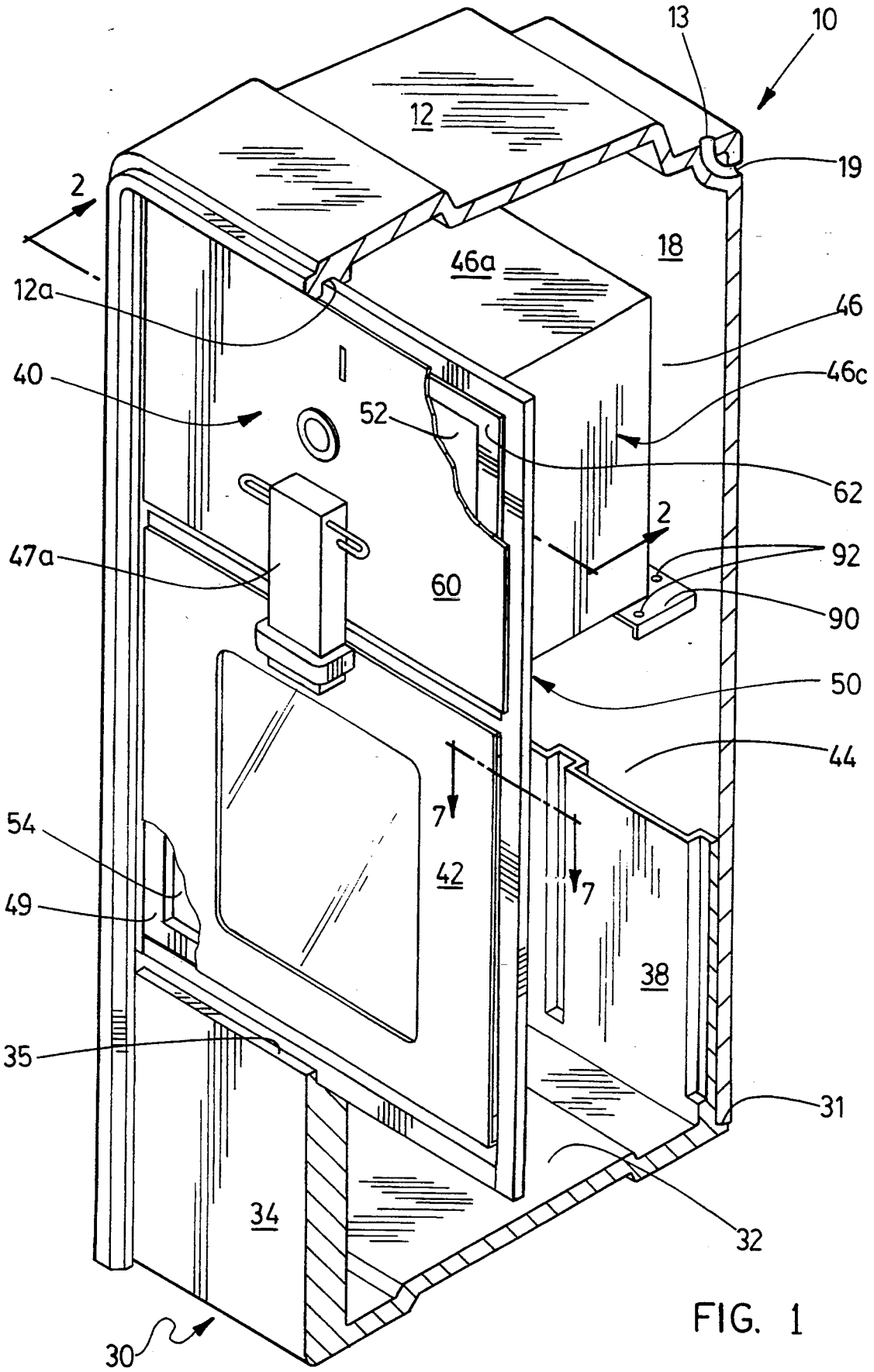
FIG. 1 is a partially cutaway perspective view showing the metal insert enclosed within the plastic cabinet.

As illustrated in FIG. 1, the invention comprises three basic components: a plastic cabinet 10, a plastic base 30 and a metal insert 40. A removable tray 96 is not shown in FIG. 1.

In a preferred embodiment the cabinet 10 comprises a top panel 12, side panels 14, 16 and a rear panel 18, preferably formed of one inch thick plastic such as polyethylene through rotational moulding, injection moulding or a like process. The base 30 is formed from a similar plastic, having a bottom panel 32 approximately one inch thick and a front panel 34 approximately two inches thick, with side panels 36, 37 and a rear panel 38 which can be of a lesser thickness because in use they are protected within the cabinet 10. The base 30 includes a lower ledge 31 on which the cabinet 10 sits.

Figure 5:
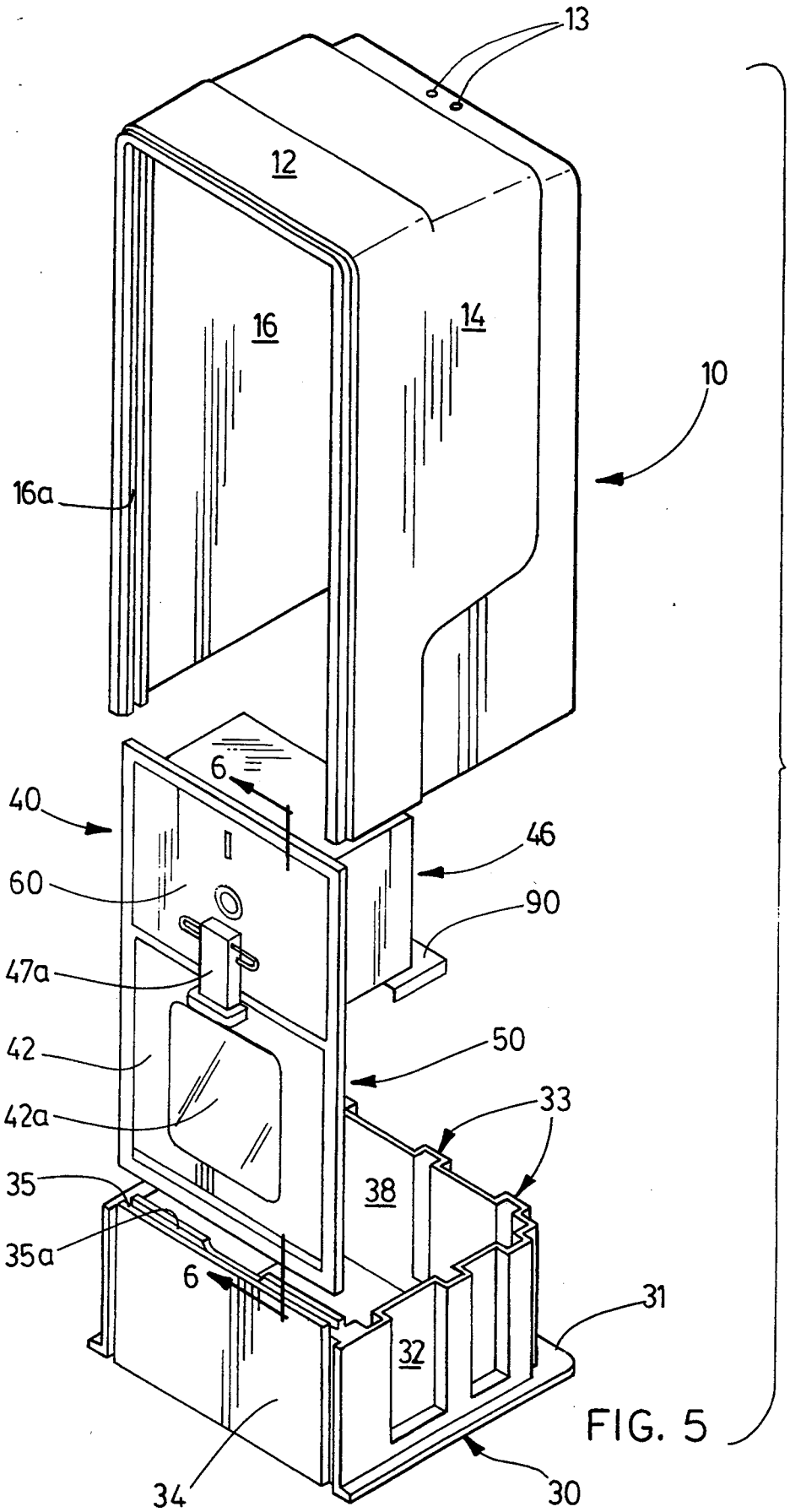
FIG. 5 is an exploded view showing the manner of assembly.

Means for retaining the metal insert 40 in the cabinet 10 comprises channels 14*a*, 16*a* and 12*a* formed in the interior front edge of the side panels 14, 16 and top panel 12 of the cabinet 10, respectively, and a complementary channel 35*a* is formed in the top edge 35 of the front panel 34 of the base 30. The insert 40, described below, is mounted into these channels such that when the cabinet 10 is fitted on the base 30 the insert 40 cannot be removed from the cabinet 10 without first lifting the cabinet 10 off of the base 30, as can be seen in FIG. 5. A pair of channels 13 extend between the top panel 12 and rear panel 18 of the cabinet 10, through which a chain can be drawn for locking the cabinet 10 to a convenient fixture such as a post, to resist attempts to lift the cabinet 10 and prevent theft of the vendor. For additional weight, cinder blocks, sand bags or other ballast (not shown) may be placed in the base 30 prior to positioning the cabinet 10 thereon.

The metal insert 40 comprises a door 42 permitting access to a storage compartment 44 contained within the cabinet 10, and a secure compartment 46 containing a conventional coin or magnetic card operated latch mechanism 47 for latching the door 42 closed and a cash box 48 for storing deposited coins. A tubular main frame 50 preferably consists of one-half inch by one inch rectangular steel tubing, and includes a top opening 52 dimensioned to correspond with the opening in the front of the secure compartment 46 and a bottom opening 54 dimensioned to surround the door 42 in a clearance fit. The bottom member 56 of the main frame 50 is preferably formed from a steel U-channel with an open bottom, allowing the door hinge 43 to be bolted thereto, as illustrated in cross-section in FIG. 6.

The secure compartment 46 comprises a top 46*a*, bottom 46*b*, sides 46*c*, 46*d* and back 46*e* preferably comprised of twelve gauge steel and welded or otherwise permanently secured together to form a secure enclosure. The compartment 46 is welded to the top opening 52 of the main frame 50.

The front panel 60 of the secure compartment 46, also of twelve gauge steel and provided with suitable openings for insertion of coins, the coin return (not shown), door latch 47 and the like, is welded to a one-half inch by one inch tubular inner frame 62 which is hinged by a piano hinge 63 to the dividing bar 58 in the main frame 50, permitting access by service personnel to the secure compartment 47.

The door 42 is composed of sixteen gauge steel welded to a one-half inch by one inch tubular door frame 49 hinged to the bottom member 56 of the main frame 50 by a piano hinge 43 welded to the door frame 49 and bolted to the bottom member 56 so that the door 42 can be removed for servicing if necessary. The door 42 may include a plastic window 42*a* as shown in the embodiment illustrated, and is conventionally provided with an armoured latch receptacle 47*a*. The door 42 is biased to a closed position, preferably with gas pistons 45 which dampen the closing action and may prevent injury to users or damage to the vendor.

Figure 2:
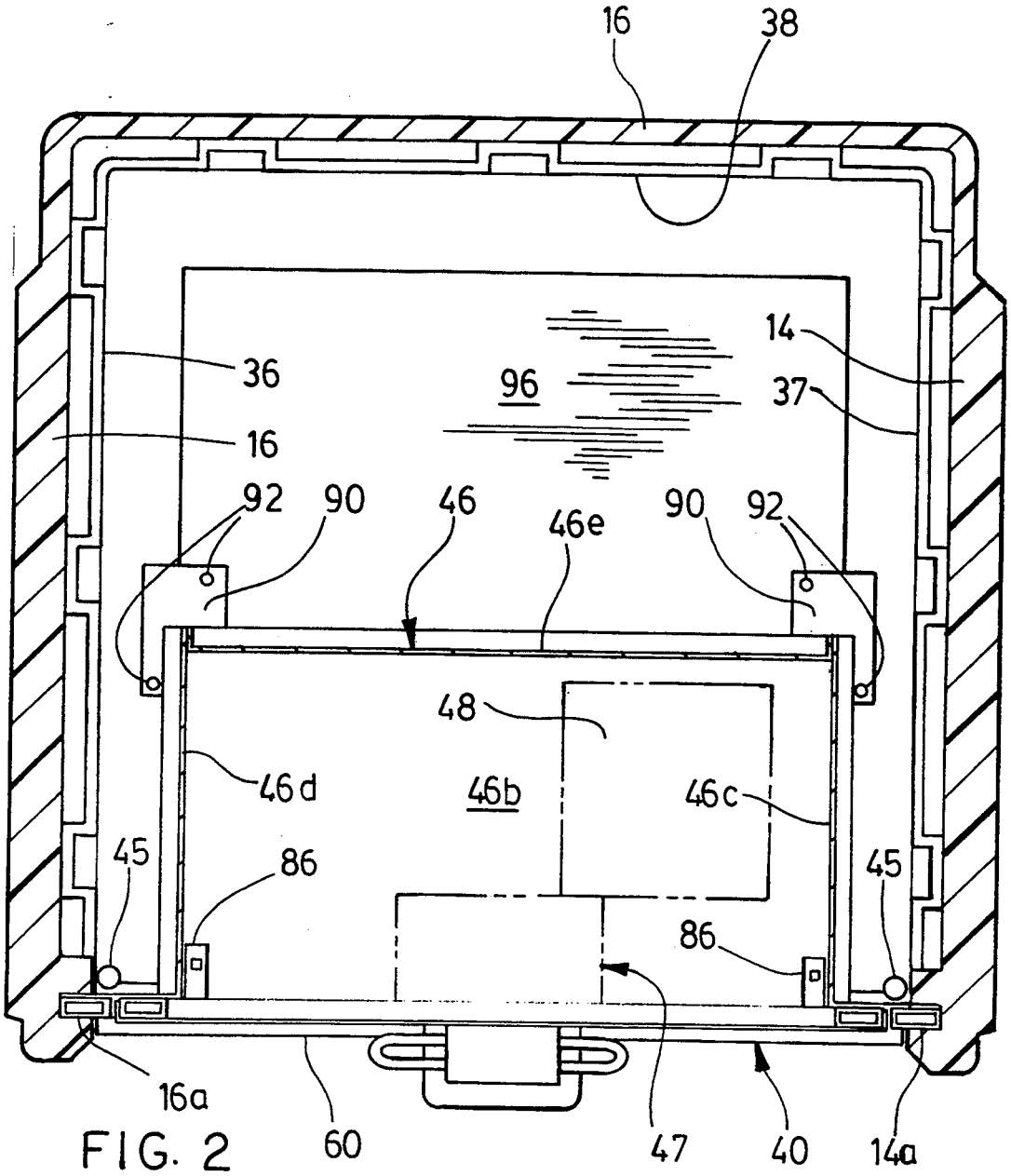
FIG. 2 is a cross-section taken along the top of FIG. 1.
Figure 3:
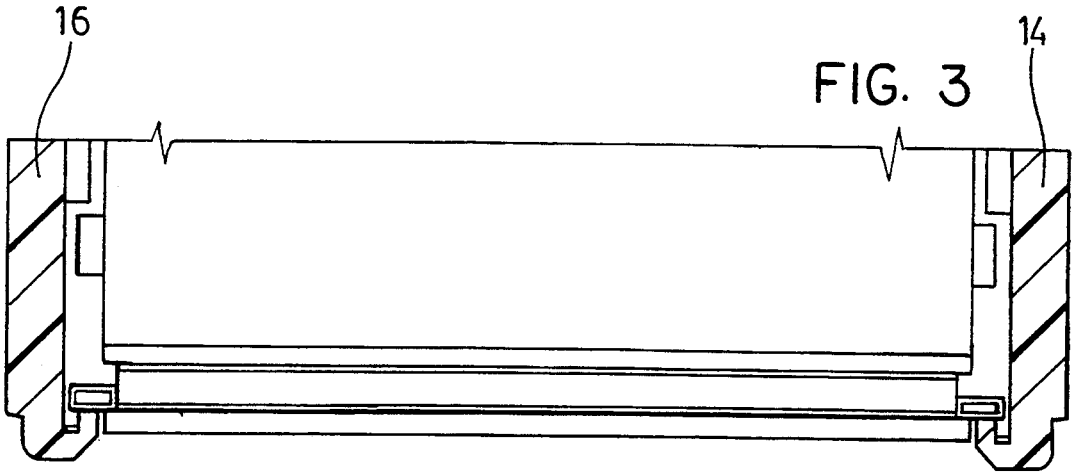
FIG. 3 is a partial cross-section taken along the bottom of FIG. 1.

The embodiment illustrated is provided with a conventional coin operated latch mechanism 47, shown in phantom in FIG. 2, which releases the door latch when the required number of coins have been deposited, as is well known. (It will be recognized that the technology exists to replace this with a magnetic card operated latch mechanism, which is contemplated within the scope of the invention.) The latch mechanism 47, and the cash box 48 into which the coins are ultimately deposited, also shown in phantom in FIG. 2, are both contained within the secure compartment 46 and are thus secure from theft and vandalism. The newspapers or like articles to be rended, which are accessed through the door 42, are contained within the storage compartment 44 within the walls of the plastic cabinet 10 and above a storage tray 70 as described below.

Figure 4:
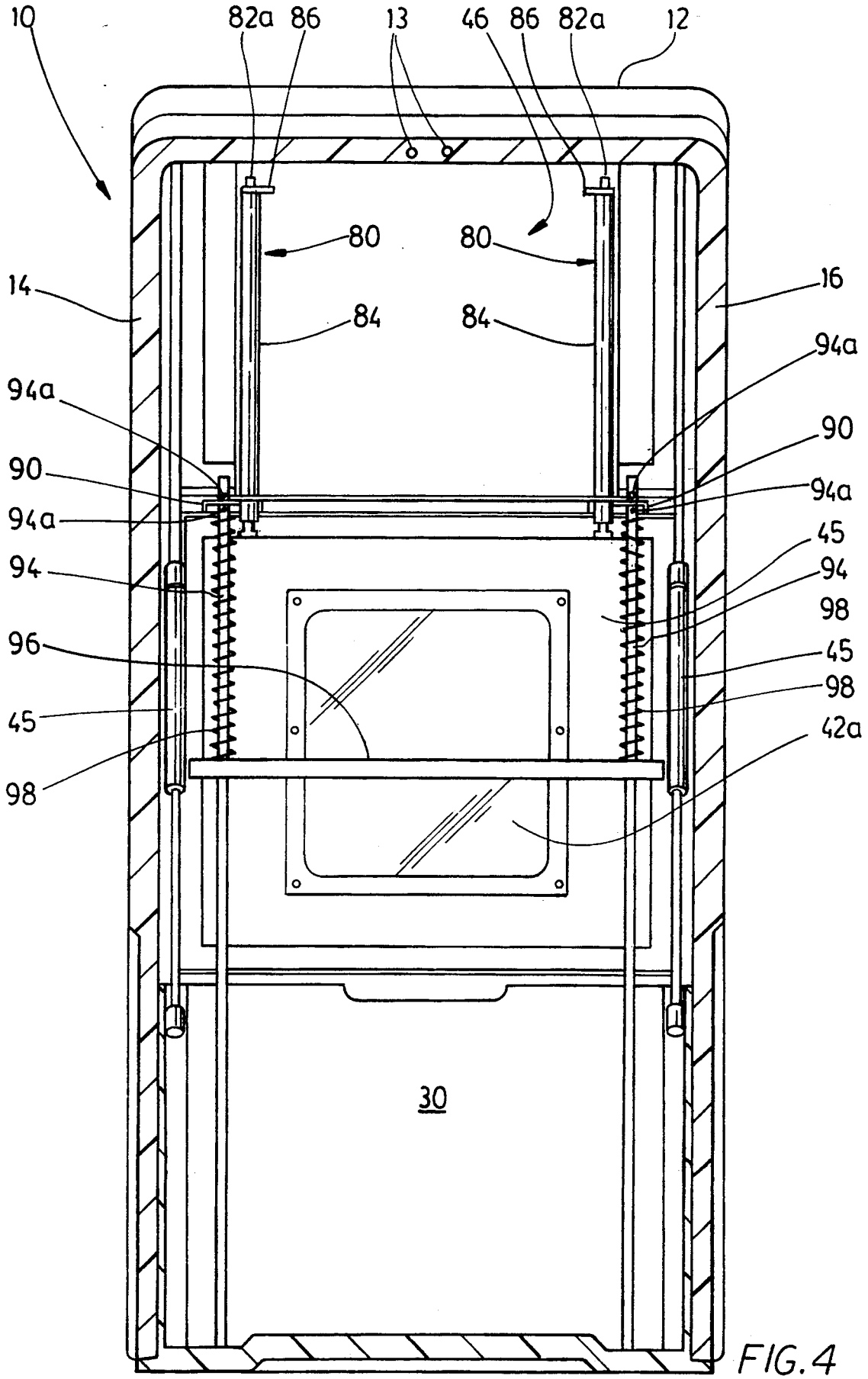
FIG. 4 is a rear elevational cross-section.
Figure 6:
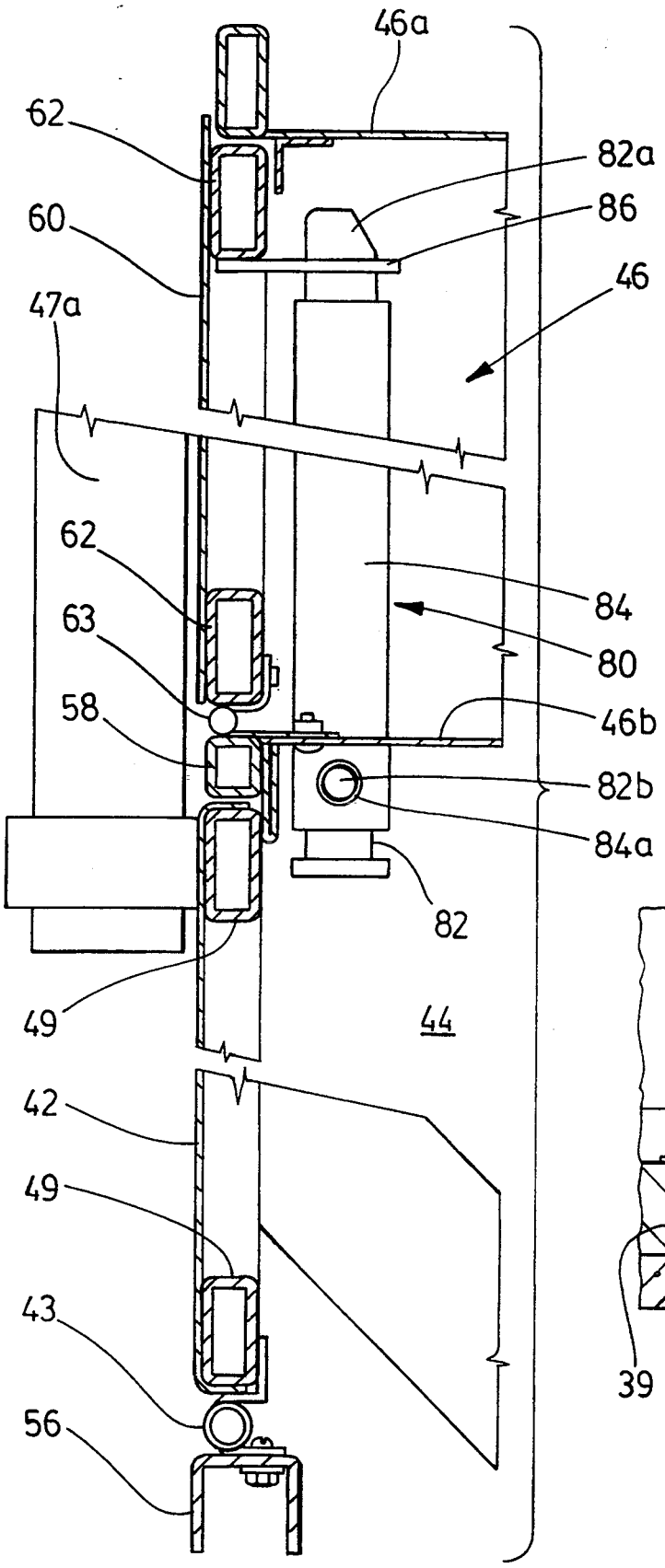
FIG. 6 is a cross-section taken along the front of FIG. 1.
Figure 7:
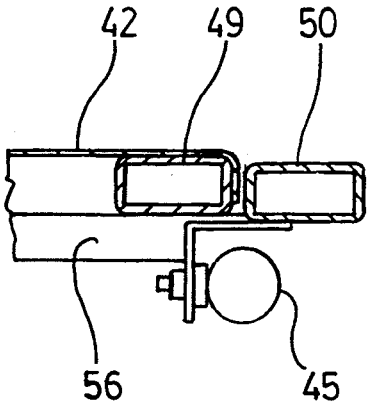
FIG. 7 is a cross-section showing details of the main frame and door frame.
Figure 8:
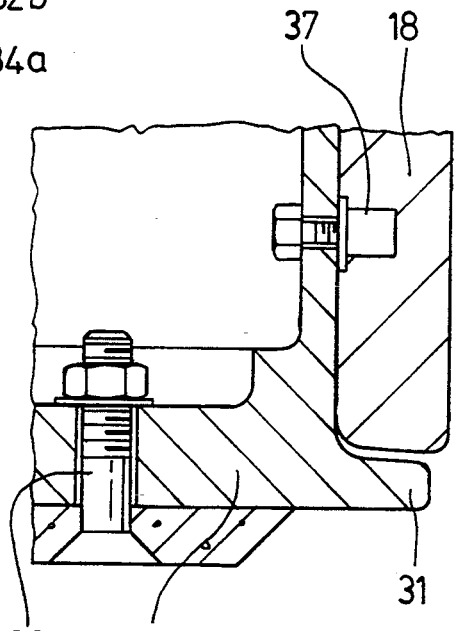
FIG. 8 is a cross-section showing details of the base.

The front panel 60 of the secure compartment 46 is locked in a closed position by a latch 80 which extends upwardly through the floor 46*b* of the secure compartment 46. Preferably a latch 80 is employed on each side of the secure compartment 46, as shown in FIG. 4. As illustrated in FIG. 6, a latch bar 82 is slidably retained in a housing 84, the latch bar 82 terminating at its top end in a tapered latch 82*a*. A latch plate 86 is welded to the frame 62 of the panel 60, and the latch 82*a* extends through the latch plate 86 in the closed position. The tapered side of the latch 82*a* faces the direction of closure of the panel 60, to draw the panel 60 snugly against the opening to the compartment 46 as the latch bar 82 is raised into position. Aligned holes 84*a* in the housing 84 and 82*b* in the latch bar 82 are accessible from the storage compartment 44 and accept the loop of a conventional padlock (not shown) which is thus protected from the elements and from vandalism inside the cabinet 10. A stop-bar or boss (not shown) may be conventionally employed to prevent the latch bar 82 from falling out of the housing 84.

Preferably the secure compartment 46 extends to approximately one-half of the depth of the cabinet 10. Metal brackets 90 having rod support holes 92 are welded to each lower rear corner of the secure compartment 46. Suspension rods 94 are inserted through one set of the support holes 92, and extend through complementary holes in a tray 96 and into a pair of depressions (not shown) in the floor 32 of the base 30. The tray 96, best seen in FIG. 4, may be wide for broadsheet style newspapers, or narrower and deeper for tabloid style newspapers, so two sets of holes 92 are provided in each bracket 90 to accommodate the different sized trays 96. A pair of nuts or pins 94*a* retains the rod 94 in the bracket 90, and the tray 96 is biased upwardly by a tension spring 98 which is affixed to the bracket 90 adjacent the hole 92 from which the rod 94 is suspended. In this fashion, as inventory is removed from the storage compartment 44 the tray 96 will rise with the reduced weight, keeping the top of the pile of newspapers or magazines generally at the level of the window in the door 42. It will be apparent that the storage tray 96 can thus be easily changed to accommodate different sizes of inventory such as newspapers or magazines, or groups thereof, as may be desired.

In use, the base 30 is placed in the desired location and optionally weighted down with bricks, cinder blocks, bags of sand or other heavy objects. The base 30 may optionally be affixed to a sidewalk, concrete pad, etc. using bolts 39 or similar securing means.

The bottom member 56 of the main frame 50 is positioned in the channel 35*a* along the top edge 35 of the front panel 34 of the base 30, and the cabinet 10 is lowered over the insert 40 such that the main frame 50 slides into the channels 12*a*, 14*a*, 16*a* formed along the front edge of the cabinet 10. When the cabinet 10 is properly seated on the ledge 31 of the base 30, the door 42 is unlatched by service personnel and securing means such as T-nuts 37 are used to secure the cabinet 10 to the base 30, preferably through recessed portions 33 extending from top to bottom along the side and rear interior walls 32, 38 of the base 30. The tray 96 is then manually lowered and stocked with newspapers, magazines or the like and the door 42 is released, latching closed until a patron inserts the required coinage to obtain access to the newspapers.

The entire insert 40 can be readily removed and replaced, for maintenance and repair purposes or to change features. For example an insert 40 containing a coin operated latch mechanism 47 in the secure compartment 46 could be readily replaced with an insert containing a credit card operated latch mechanism 47.

Through expansion and contraction with changes in temperature and sunlight, and constant opening and closing of the access door 42, the door latch mechanism 47 would fail very quickly if a plastic door 42 or latch 47 were employed, because it would quickly lose the close tolerances required for such a mechanism to work reliably. By constructing the door 42 and latch mechanism 47 out of metal, and using metal to form the secure compartment 46 in which the latch mechanism 47 and deposited coins are stored, this invention provides the advantages of a secure and durable metal newspaper vendor, but exposed portions are largely made of plastic which is more durable over time and less expensive.

The invention having been described with reference to a preferred embodiment, it will be recognized by those skilled in the art that certain modifications and adaptations may be made without department from the scope of the invention, as set out in the appended claims.

I claim:

1. A vendor for newspapers or other articles, comprising a plastic cabinet having a top panel and a rear panel extending between side panels, and an open front and bottom forming front and bottom opening, an insert comprising a frame having a door adjacent to a secure compartment, the door being locked by a latch mechanism contained within the secure compartment, and vertical channels being provided along interior faces of the side panels, the channels comprising opposed outer lips for retaining and insert within the cabinet, the channels each having an open bottom open in the direction of the bottom opening of the cabinet, to permit the frame of the insert to be inserted into the channels through the bottom of the cabinet, whereby when the insert is inserted into the cabinet a storage compartment is formed within the cabinet for storing newspapers or other articles.

2. The vendor defined in claim 1, wherein the frame of the insert is tubular.

3. The vendor of claim 1, including a base comprising a bottom panel and a front panel, inserted into the cabinet through the bottom of the cabinet, whereby a top edge of the front panel of the base supports the insert within the cabinet.

4. The vendor of claim 1, wherein the secure compartment has a front access closed by a hinged panel having a latch plate extending into the secure compartment, and including a latch operable within the secure compartment to secure the hinged panel in a closed position, the latch including a latch bar having means extending into the storage compartment for inserting a padlock.

5. The vendor of claim 1, including a storage tray suspended in the storage compartment from suspension rods affixed to the secure compartment.

6. A vendor for newspapers or the like comprising in combination a plastic cabinet having a top panel and rear panel extending between side panels, an open front and an open bottom, the side panels of the cabinet each being provided with a vertically extending retaining channel, and an insert comprising a frame dimensioned to nest in the channels in slip fit relation, a door hingedly attached to a portion of the frame and a secure compartment comprising front, rear, top, bottom and side walls affixed to the frame adjacent to the door, whereby the insert is inserted into the cabinet through the open bottom of the cabinet such that the frame of the insert slips into the channels and the insert is thereby retained within the cabinet, and a base having a front wall including a top edge, the base being inserted into the bottom of the cabinet such that the insert is supported on the top edge of the base.

7. The vendor of claim 7, wherein the frame of the insert is tubular.

8. The vendor of claim 7, wherein the secure compartment has a front access closed by a hinged panel attached to the frame, the hinged panel being provided with a latch plate extending into the secure compartment, and including a latch operable within the secure compartment to secure the hinged panel in a closed position.

9. The vendor of claim 7, in which a storage compartment for newspapers or other articles is defined by the side and rear walls of the cabinet, the door, and the bottom wall of the secure compartment.

10. The vendor of claim 9, including a storage tray suspended in the storage compartment from suspension rods affixed to the secure compartment.

11. The vendor of claim 10, in which the latch includes means extending into the storage compartment for inserting a padlock.

12. The vendor of claim 7, in which the base is affixed to the cabinet.

13. The vendor of claim 1, in which the secure compartment is located above the door.

14. The vendor of claim 7, in which the secure compartment is located above the door.

* * * * *